US005542476A

United States Patent [19]

Hansen

[11] Patent Number: 5,542,476

[45] Date of Patent: Aug. 6, 1996

[54] APPARATUS FOR DRILLING AND MAINTENANCE OF HOLES IN A GOLF COURSE

[76] Inventor: Finn H. Hansen, Sct. Mogensgade 23C, DK-8800 Viborg, Denmark

[21] Appl. No.: 343,502

[22] PCT Filed: May 25, 1993

[86] PCT No.: PCT/DK93/00178

§ 371 Date: Nov. 23, 1994

§ 102(e) Date: Nov. 23, 1994

[87] PCT Pub. No.: WO93/24708

PCT Pub. Date: Dec. 9, 1993

[30] Foreign Application Priority Data

May 25, 1992 [DK] Denmark ..... 0677/92

[51] Int. Cl.[6] ..... A01B 45/02

[52] U.S. Cl. ..... 172/22; 175/20; 166/240

[58] Field of Search ..... 172/19, 22, 25, 172/111; 175/20, 162, 203; 166/240

[56] References Cited

U.S. PATENT DOCUMENTS

| | | | |
|---|---|---|---|
| 3,817,337 | 6/1974 | Panak et al. . | |
| 3,912,009 | 10/1975 | Davis | 166/240 |
| 4,566,543 | 1/1986 | Kotani | 172/21 |
| 4,763,735 | 8/1988 | Gay . | |
| 4,836,294 | 6/1989 | Bencriscutto . | |
| 4,884,638 | 12/1989 | Hoffman . | |
| 4,947,938 | 8/1990 | Fricke et al. . | |
| 5,090,486 | 2/1992 | Jones | 175/162 |
| 5,242,024 | 9/1993 | Van Houten | 172/19 |
| 5,394,949 | 3/1995 | Wright et al. | 175/20 |

*Primary Examiner*—Spencer K. Warnick, IV

*Attorney, Agent, or Firm*—Jacobson, Price, Holman & Stern, PLLC

[57] ABSTRACT

The invention relates to an apparatus for drilling an maintaining holes in golf courses. It is built onto a mini-tractor with the drilling unit itself suspended in a hydraulic hoist for moving up and down between a raised and a lowered position. The drilling unit is equipped with a downward directed hollow auger which is operated by the tractor. The apparatus is characteristic in that the vertical drill spindle of the drilling unit is designed as a hollow shaft in which the tubular hollow auger is inserted. The hollow auger is inserted from the top and is provided with an upward facing handle which has a transverse grip at the top. Between the hollow auger and the driven hollow shaft-drill spindle there is an anti-turn locking device, for example of the bayonet type. The quick and convenient way of removing the auger from the apparatus for manual transfer of the cut-out turf core form the hollow auger into the previous (old) hole.

5 Claims, 2 Drawing Sheets

APPARATUS FOR DRILLING AND MAINTENANCE OF HOLES IN A GOLF COURSE

BACKGROUND OF THE INVENTION

Apparatus for drilling and maintenance of holes in a golf course The invention relates to an apparatus for drilling and maintaining holes in golf course greens, where new holes are cut at regular intervals and the used (old) holes they are replacing are plugged The work is usually performed at intervals of a few days. The apparatus is of the type that is built onto a mini-tractor (lawn tractor or similar mobile mini-tractor unit), with the drilling unit itself suspended in a hydraulic hoist for moving the unit up and down between a raised transport position and a lowered drilling position. The drilling unit is equipped with a downward directed hollow auger, which is operated by the tractor via its hydraulic or mechanical power take-off.

The golf course holes are in so-called greens, viz. very smooth, closely mown areas of high-quality grass. The holes—there is one in each green—have a diameter of 108 mm and a depth of exactly 175 mm. The holes must have a well-defined, sharp edge (rim) to achieve a completely neutral effect on a rolling ball, so that the ball neither encounters resistance at the rim of the hole nor gets pulled in towards the hole by a "funnel effect". For obvious reasons, both greens and holes are of vital importance to the game because the concluding strokes take place on the green.

As the holes are situated in the grass's growth zone, the grass at the rim of the hole withers relatively quickly (in the growth period within about 1 day). At the same time, the heavier traffic just around the hole means that the grass gets trampled and worn in a relatively small area around the hole. This can naturally not be accepted, so it is necessary to maintain the holes at regular intervals (daily in the high season) and to cut new, sharp-rimmed holes and at the same time plug the old holes in order to spread the traffic and thus also the wear over a larger area of the green. The old holes are plugged with the turf removed from the new holes. As each hole is plugged it is trodden down with a foot to achieve a smooth surface.

The work can be done manually with a special hollow auger equipped with a long handle with a transverse grip. However, doing the job manually is both time-consuming and fatiguing. For this reason and because of a general need to rationalise the operation of golf courses, machines and various types of aids have been developed for the maintenance work described.

One example of such an aid is known from U.S. Pat. No. 4,836,294, which relates to a tractor-mounted drilling machine for cutting holes in golf course greens. The drilling machine is suspended in a lift-like hoisting arrangement mounted on the back of a mini-tractor of the type typically used for mowing grass at golf courses and other maintenance work. The drilling unit, which is operated by the tractor's motor via a hydraulic power outlet, is suspended, vertically adjustable in relation to the tractor, in a first frame. The auger itself is bedded in a second frame, the angle of which can be adjusted in relation to the first frame by turning it around a horizontal axis. This means that the auger can be put into an exactly vertical position regardless of the slope of the ground. During cutting, the auger rotates around its own axis, under the action of a hydraulic motor. The auger is a hollow auger, i.e. like a piece of pipe with a cutting edge at the bottom. Inside it there is a device for ejecting the removed turf core.

As mentioned the removed turf core is placed in the old hole. The procedure here is as follows: After cutting a new hole the tractor is manoeuvred back to the old hole, where the drilling unit is positioned exactly over the hole. The auger is moved into the vertical position, and only then can the auger with the core be pressed down in the hole and the core released The whole procedure is tedious and time-consuming, and, in practice, the necessary positioning and alignment of the auger in relation to the existing (old) hole causes a lot of problems. If the auger is pressed into the hole crookedly or a little to one side, the hole gets deformed and it becomes very difficult to tread the turf core properly into place so that it is completely flush with the surface of the grass. For obvious reasons this is an absolute requirement.

SUMMARY OF THE INVENTION

The apparatus according to the invention has the characteristic feature that the vertical drill spindle in the drilling unit is designed as a hollow shaft in which the tubular hollow auger can be inserted and from which it can be removed. The auger is inserted from the top and is equipped with an oblong, upward facing shaft with a transverse grip at the top. Between the hollow auger and the driven hollow shaft/drill spindle there is an anti-turn locking device, for example of the bayonet type, which is designed to enable the hollow auger to be inserted in and removed from the drill spindle with one or two movements of the hand—in other words, without use of tools. The hollow auger is open at the top to allow manual ejection of the turf core removed with the auger and coming up with this when the cutting is completed and the auger is withdrawn from the hole.

The quick coupling between the hollow auger and the drill spindle enables the operator to remove the auger quickly and easily fom the machine for manual insertion of the turf core directly from the auger into the previous (old) hole. This procedure is considerably faster and easier than the earlier method in which the whole tractor had to be manoeuvred to the old hole until the auger was exactly over this before the turf core could be ejected. The new invention means that the often time-consuming and manpower-consuming work of maintaining golf course holes can be done in a far more rational and convenient way and also results in improved quality of the work.

A preferred embodiment of the locking device between the hollow auger and the drill spindle is indicated.

The bayonet mechanism excels by being simple in design and without moving parts, making it both robust and reliable. The guide slots of the bayonet lock are arranged so that the locking effect between the two parts intensifies under the loads—both radial and axial—to which the auger is subjected during operation. To prevent the auger from accidentally coming apart from the drill spindle when this is not loaded, e.g. during transportation, the mechanism can advantageously be provided with a non-return spring that holds the tappets flexibly in place in the blind track of the guide slots.

BRIEF DESCRIPTION OF THE DRAWINGS

The invention is explained in greater detail in connection with the drawing, in which.

DESCRIPTION OF PREFERRED EMBODIMENT

Figure 1:
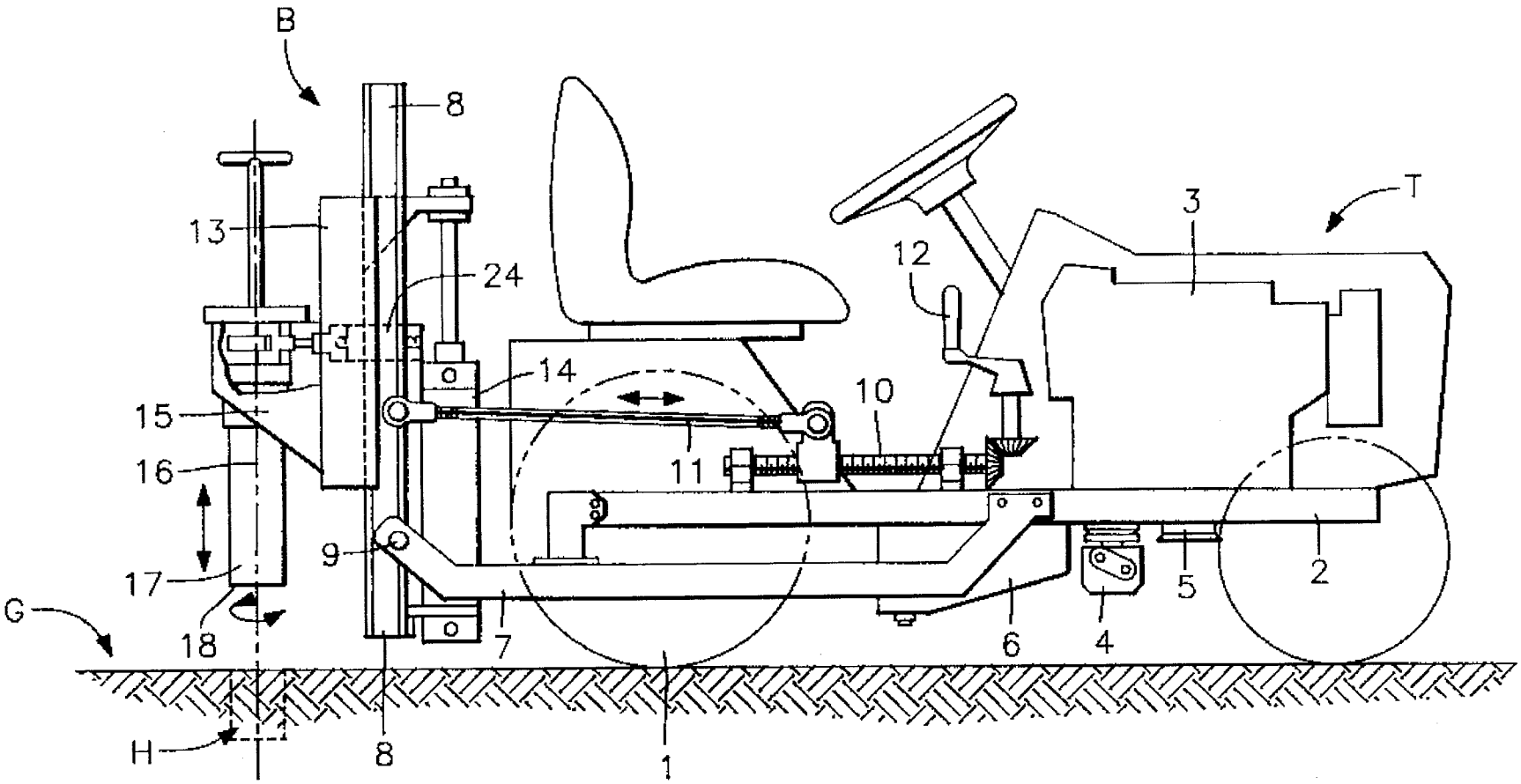
FIG. 1 shows a tractor-mounted drilling apparatus according to the invention, in a schematic side view, FIG. 2 a section of the coupling between the hollow auger and the drill spindle in details, partly in cross section, FIG. 3 a side view of the hollow auger itself, in the direction of the arrows A—A in FIG. 2, and FIG. 4 a cross section through the line B—B in FIG. 3.

In the embodiment shown in the drawing the drilling apparatus B is mounted on a mini-tractor T of the type commonly used for general maintenance work at golf courses, including mowing and rolling grass. The tractor is modified with respect to power take-off and tool suspension (hoist arms).

In the drawing 1 indicates the wheel assembly of the tractor, 2 the chassis frame of the tractor and 3 the motor. A hydraulic pump 4 is mounted under the motor with drive from this via a V belt drive 5. A hydraulic oil tank 6 is mounted under the chassis frame 2, The hydraulic system serves as power transmission to the drilling apparatus B.

The drilling apparatus B is suspended in two longitudinal backward facing frame arms 7 which are bolted to the chassis frame 2 of the tractor. The drilling apparatus is mounted at the rear of the tractor and is carded by a system of guide and swing frames, the first of which, 8, serves as a vertical guide for the drill unit B itself. The angle of the frame 8 relative to the frame arms 7 can be adjusted by turning it about two hinged points 9. The angular adjustment of the frame is effected by means of a threaded spindle mechanism 10 which is connected to the frame 8 via a hinged bar 11 on each side. The threaded spindle mechanism 10 is operated from the tractor driver's seat by means of a crank handle 12. The angle adjustment function is used for vertical alignment of the drill shaft before drilling.

As mentioned the frame 8 forms a vertical guide for a second frame 13 which can be moved vertically between a raised transport position (shown) and a lowered drilling position. The frame is moved by means of a vertical hydraulic cylinder 14. A backward facing bracket 15 on the frame 13 serves as a support for the drill unit B itself. This is placed with the axis of the drill 16 in the vertical position. The auger 17 is a tubular auger with the cutting edge at the bottom 18.

Figure 2:
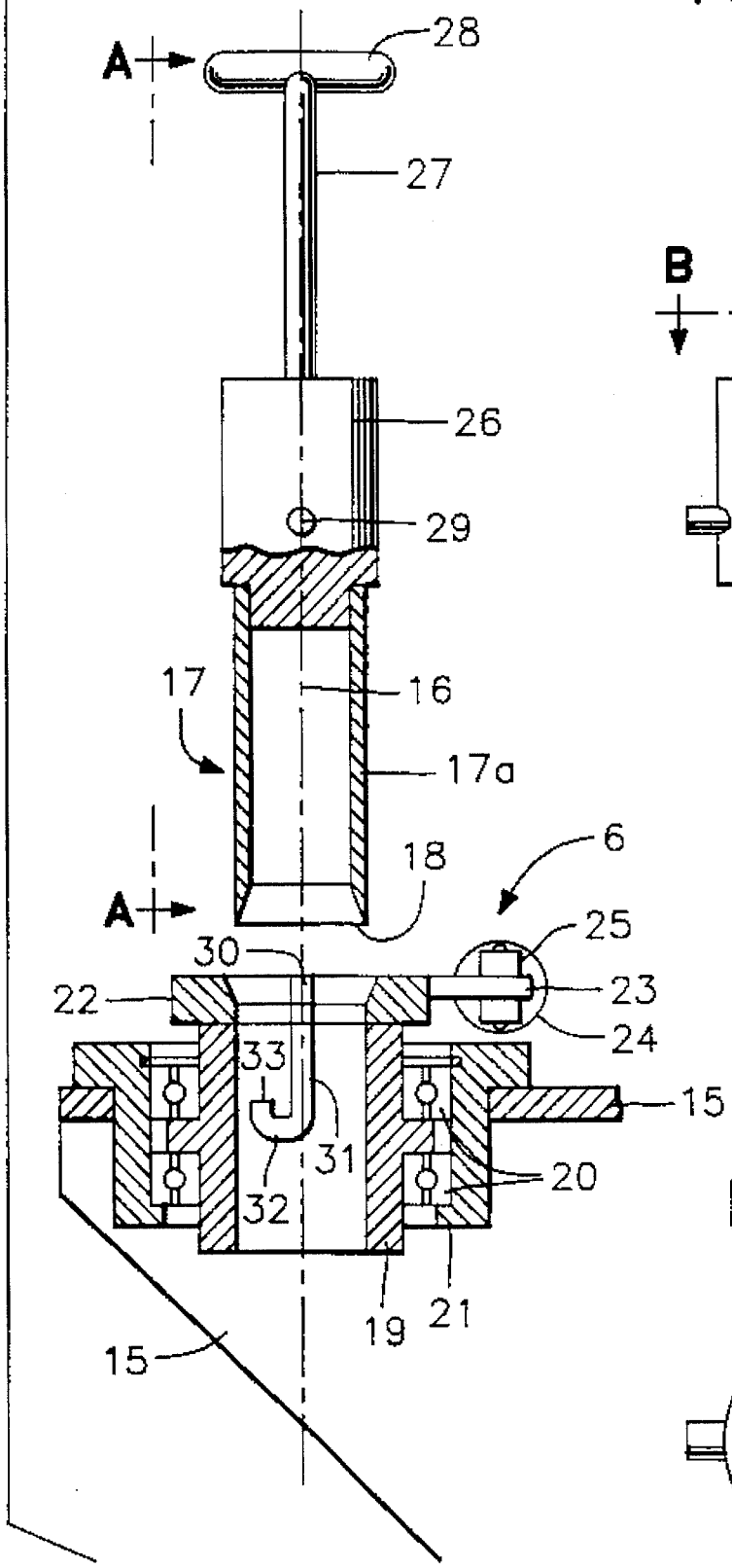
Figure 3:
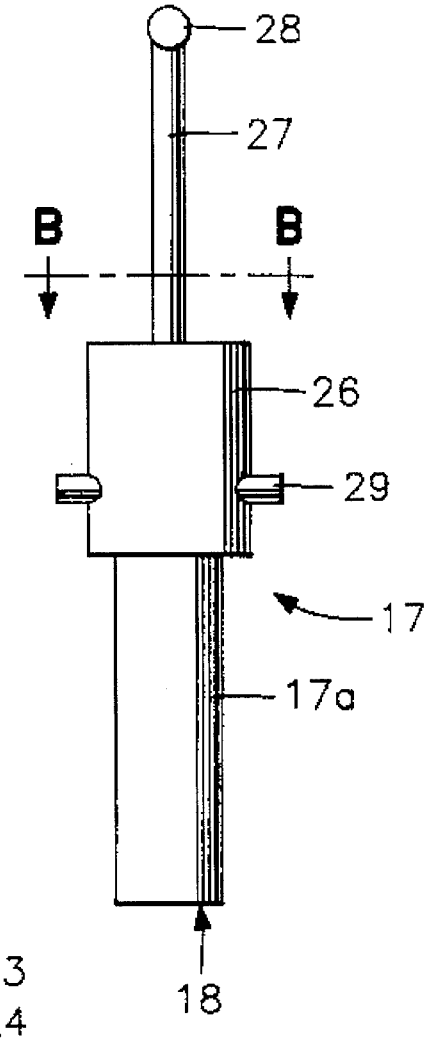
Figure 4:
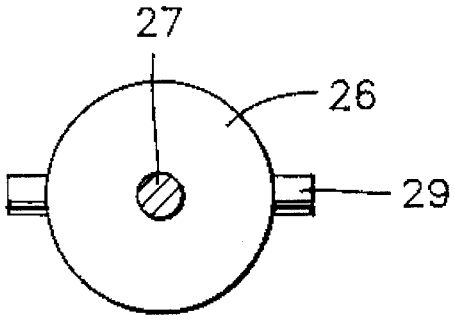

The drill unit B itself consists mainly of a rotating drill spindle 19 shaped like a hollow shaft with room for the auger 17, vide FIG. 2. The drill spindle 19 is bedded in ball bearings 20 (axial and radial bearings) in a bearing housing 21 which is in turn mounted on the above-mentioned bracket 15. A collar 22 is fixed to the top of the drill spindle. The collar is provided with an outward directed arm 23. This is used for intermittently turning the drillspindle backwards and forwards, for example 60 degrees, under the action of a hydraulic cylinder 24 which acts on the arm through a hinged point 25. The intermittent turning serves as drilling movement during cutting of a new hole H during which the auger 17 is at the same time pressed down into the green G by the vertical guide cylinder 14.

The auger 17 consists of a sharpened piece of pipe 17*a* which is inserted in a cylindrical drill head 26. The auger is provided with an upward facing handle 27 with a transverse grip 28. Two diametrically opposed, radially projecting tappets 29 are placed on the drill head 26 to prevent the auger from turning in the drill spindle 19.

The auger is inserted in the drill spindle from above, during which the tappets 29 are inserted in two corresponding guide slots 30 inside the hollow shaft (drill spindle 19). The guide slots 30 each have a vertical inlet section 31 which is open at the top and which continues from its lower end into a horizontal intermediate section 32, which in turn continues upwards in a short upward facing blind track 33. When the auger is inserted in the drill spindle the tappet 29 is first pushed down through the horizontal section of the slot 31 and is then made to pass the horizontal section of the slot 32 by turning the auger. Finally the auger is pulled upwards so that the tappet locks into place in the blind track 33. The auger maybe held firmly in place by a spring mechanism (not shown) (secured against turning and shifting upwards) during the drilling operation. The anti-turn mechanism is designed to allow quick and easy insertion of the auger in the drill spindle and removal from same.

The mode of operation of the drilling apparatus will not be explained in greater detail here, being largely explained in the opening part. As mentioned the drilling apparatus is powered by the motor of the tractor via the hydraulic power take-off (pump 4 and transmission 5).

The invention is not limited to the embodiment shown in the drawing and specified above. Other detailed embodiments of the coupling between the hollow auger and the drill spindle are of course possible within the frames of the present invention. For example, the coupling may comprise a spring-loaded lock pin which can be released from outside by a mechanical release mechanism placed in the auger handle.

I claim:

1. Apparatus for drilling and maintaining holes in greens on golf courses where new holes are regularly cut and used (old) holes plugged, which apparatus is constructed as a mini-tractor with a drilling unit suspended in a hoist arrangement on the tractor for movement between a raised transport position and a lower cutting position, and with the drilling unit having a hollow auger to be driven by the tractor via a power take-off of the tractor, characterized in that the drilling unit has a driven drill spindle in the form of a hollow shaft in which the hollow auger is inserted, the hollow auger is inserted in the hollow shaft from above and is provided with an upward facing handle and between the hollow auger and the hollow shaft there is a bayonet anti-turn locking device arranged in such a way that the hollow auger can be released and removed from the hollow shaft by hand.

2. Apparatus according to claim 1, characterized in that the said locking device is a bayonet lock comprising at least one outward facing tappet on the auger arranged for inserting in a corresponding guide slot inside the hollow shaft, the guide slot having a vertical inlet section which is open at the top, with a lower end which connects with a horizontal intermediate section which in turn connects with an upward blind section so that an axial compressive force on the auger results in intensified locking action when the tappet is in the blind section of the guide slot.

3. Apparatus according to claim 2, characterized in said locking device comprises another outward facing tappet on the auger diametrically opposed to said at least one tappet and another guide slot in the hollow shaft for said another tappet.

4. Apparatus according to claim 1, characterized in that the upward facing handle of the hollow auger is provided with a transverse grip.

5. Apparatus according to claim 1, characterized in the drill spindle is connected to a hydraulic cylinder via a lever to turn the spindle backwards and forwards a given number of angles in an intermittent working movement during a cutting process.

* * * * *